US005664259A

United States Patent [19]

Budd

[11] Patent Number: 5,664,259

[45] Date of Patent: Sep. 9, 1997

[54] SHIRT WITH ATTACHED HEAD GARMENT

[76] Inventor: Hilliard Budd, 4700 Lake Rd., Miami, Fla. 33137

[21] Appl. No.: 574,072

[22] Filed: Dec. 18, 1995

Related U.S. Application Data

[63] Continuation-in-part of Ser. No. 349,731, Dec. 2, 1994.

[51] Int. Cl.[6] ..... A41B 1/00

[52] U.S. Cl. ..... 2/115; 2/84; 2/195.1; 2/209.12

[58] Field of Search ..... 2/115, 105, 106, 2/108, 84, 46, 48, 51, 69, 88, 79, 104, 90, 243.1, 83, 94, 95, 195.1, 209.11, 209.12; D2/717, 866

[56] References Cited

U.S. PATENT DOCUMENTS 4,392,258 7/1983 O'Neill ..... 2/115

*Primary Examiner*—C. D. Crowder
*Assistant Examiner*—Gloria Hale
*Attorney, Agent, or Firm*—Robert M. Downey, P.A.

[57] ABSTRACT

A shirt includes a main front panel and a main rear panel each including a lower edge, the front and rear panels being attached to one another along corresponding peripheral edge portions to define a neck opening, opposite arm openings, and a bottom opening surrounded by the lower edges of the front and rear panels, and a bib panel attached to the shirt and extending downwardly therefrom between the front and rear panels. An article defining a head garment is attached to a lower end of the bib panel. The head garment can be worn while the shirt is donned on the wearer's body by pulling the bib panel over the back of the head to position the head garment on the wearer's head.

10 Claims, 1 Drawing Sheet

SHIRT WITH ATTACHED HEAD GARMENT

BACKGROUND OF THE INVENTION

This application is a continuation-in-part application of co-pending patent application Ser. No. 08/349,731 filed on Dec. 2, 1994.

FIELD OF THE INVENTION

The present invention relates to shirts and like garments including head wear attached thereto which can be selectively worn or removed from the user's head while the garment is being worn.

DESCRIPTION OF THE RELATED ART

In the apparel art, it has been known to fit various garments with a bill, visor, or hood to be worn on the head to protect the head and face from the elements. In particular, shirts and jackets having hoods have been known to include a bill attached to the hood so that when the hood is worn on the user's head, the bill extends from the forehead to shade the eyes from sunlight. It has also been known to fit an article of clothing such as a t-shirt with a bill attached at the rear of the neck opening so that the clothing can be worn as an ordinary shirt with the bill depending from the back of the neck opening or, alternatively, the shirt can be removed from the wearer's upper body and worn over the head like a turban with the bill serving as an eye shade. This type of shirt is disclosed in U.S. Pat. No. 4,392,258 to O'Neill.

It has been recognized that in the past, if it is desirous to wear both a shirt and a hat, such as a sun visor, it is necessary to have separate articles, namely a hat and a shirt, unless the shirt is fitted with a hood having the visor thereon. Shirts having a hood fitted thereon are sometimes not desirable because the appearance of the hood, when removed, is bulky and does not give the neat appearance of a conventional shirt.

Accordingly, there still exists a need in the apparel art for a shirt or like garment having optional head wear fixedly attached thereto and which can be concealed from normal view when removed from the wearer's head.

SUMMARY OF THE INVENTION

The present invention is directed to a garment having front and rear panels attached about peripheral edge portions to define a neck opening, opposite arm openings, and a bottom opening surrounded by a lower edge of the front and rear panels. The front and rear panels are specifically structured and configured to substantially cover the torso of the wearer with the garment being worn as a shirt.

A third panel or bib panel is attached to the shirt so that the bib panel normally extends downwardly therefrom between the front and rear panels to a lower free end zone. A head garment such as a sun visor, bill, or hood is attached to the lower end zone of the bib panel. Both the bib panel and head garment are normally concealed between the front panel and the wearer's chest and stomach, or between the rear panel and wearer's back, when the shirt is worn in a conventional manner. If it is desirous to wear the head garment, the bib panel is pulled over the wearer's head so that the bib drapes down the back of the head while the head garment is properly fitted on the wearer's head. The shirt can be worn either with the front panel covering the front of the wearer's body and the back panel covering the back of the wearer or, alternatively, the front panel can be pulled over the head and around the back of the neck to expose the chest and stomach area.

Accordingly, the shirt can be worn in a conventional manner with the bib panel and head garment extending downwardly from the neck opening between the shirt and the wearer's body so that both the bib panel and head garment are concealed from normal view.

Alternatively, the head garment can be worn, with the bib panel draped over the back of the head and the main panel either worn in covering relation to the front body or pulled over the back of the neck to expose the chest and stomach.

Strings on the bib panel enable the bib panel to be tied back behind the head, much like a bandanna, exposing the sides and a portion of the back of the head. Alternatively, the strings can be tied under the chin to pull the bib panel over the sides of the head, covering the ears and neck.

With the foregoing in mind, it is a primary object of the present invention to provide a shirt or like garment, including head wear attached thereto adapted to be selectively worn on the user's head or removed and concealed from normal view.

It is a further object of the present invention to provide a shirt or like garment including a front panel, a rear panel, and a third panel defining a bib having a head garment attached thereto which can be selectively worn on the head so that the bib covers the back of the head or removed so as to be concealed from normal view between the shirt and wearer's body.

It is still a further object of the present invention to provide a shirt or like garment comprising a front panel, a rear panel, and a third panel, defining a bib having a head garment such as a bill, visor, or hood attached thereto which can be selectively worn on the user's head or removed and concealed from normal view.

These and other objects of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
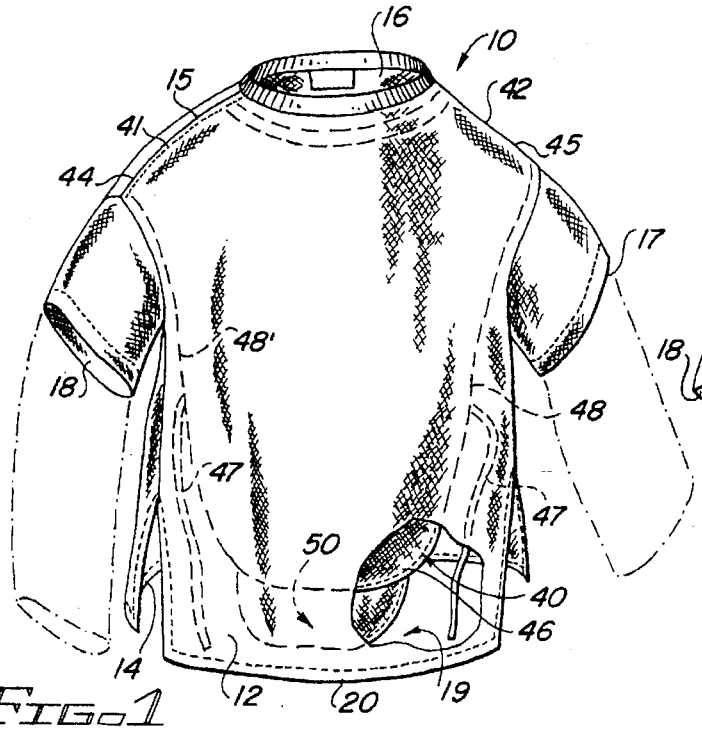
FIG. 1 is a front perspective view of the shirt of the present invention showing a bib panel thereof in broken lines between a front and rear panel of the shirt.

Referring initially to FIG. 1, there is generally illustrated the garment 10 of the present invention including a front panel 12 and a rear panel 14 attached to the front panel about peripheral edge portions 15 to form a neck opening 16, opposite arm openings 17, 18 and a bottom opening 19 surrounded by a lower edge 20 of the front and rear panels. In viewing the several figures of the drawings, it is readily apparent that the front and rear panels are sized, configured and constructed to define a shirt or like upper body garment for covering the upper torso 110 of a wearer 100. The shirt 10 further includes a third panel or bib panel 40 attached along opposite upper side edges 41, 42 to corresponding seams 44, 45 connecting the front and rear panels on opposite sides of the neck opening 16. The bib panel 40 extends downwardly from the attachment along the seams 44, 45 between the front panel and rear panel 14 of the shirt 10. The bib panel 40 further includes a lower end zone 46 and tie strings 47 attached to side edges 48, 48' of the bib panel 40 midway between the lower end zone and the opposite upper edges 41, 42 thereof.

A head garment 50, such as a visor, cap, hood or the like is integrally attached to the lower free end zone of the bib panel 40. When the shirt 10 is worn in a conventional manner, so that the front panel covers the front of body of the upper torso and the rear panel covers the back, the bib panel 40 and head garment 50 are concealed between the front panel 12 and the wearer's body. When it is desirous to wear the head garment 50, the head garment 50 and bib panel 40 are pulled up through the neck opening 16 and over the wearer's head. Next, the head garment 50 is positioned and fitted to the wearer's head so that the bib panel 40 drapes down the back of the head and into the neck opening of the shirt 10.

Figure 2:
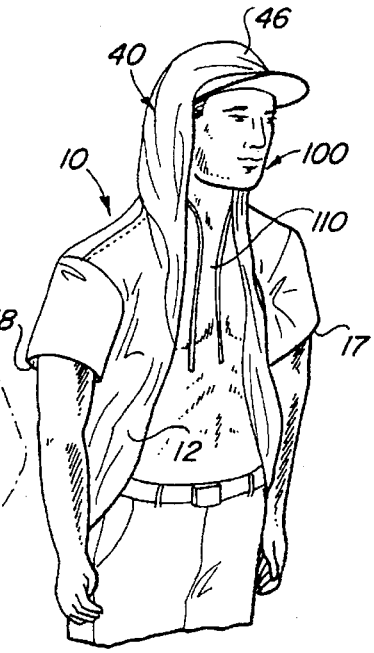
FIG. 2 is a perspective view illustrating the shirt of FIG. 1 being worn on a user with the bib panel and a head garment worn over the user's head in accordance with one preferred embodiment of the present invention.

In accordance with the embodiment of FIG. 2, the head garment 50, in this particular case a visor, can be selectively worn with the bib panel 40 draped over the back and sides of the wearer's head and the front panel 12 of the shirt 10 pulled over the back of the head across the neck to expose the wearer's chest and stomach.

Figure 3:
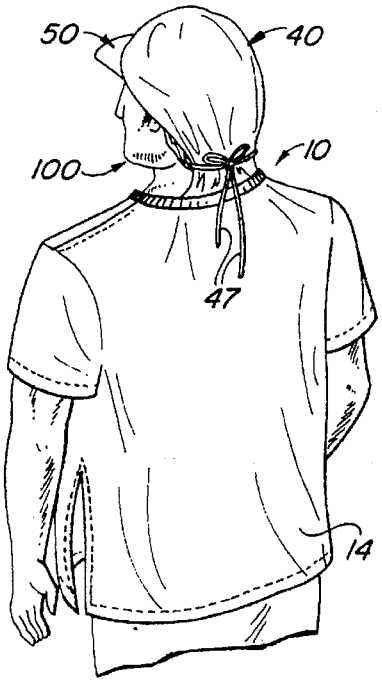
FIG. 3 is a rear perspective view illustrating the bib panel and head garment being worn in accordance with a second preferred embodiment of the present invention.

In the embodiment of FIG. 3, the head garment 50 is worn on the head with the bib panel 40 draped over the back of the head and tied back with the ties 47 to expose the sides and a portion of the neck while the shirt 10 is worn in covering relation to the upper body.

Figure 4:
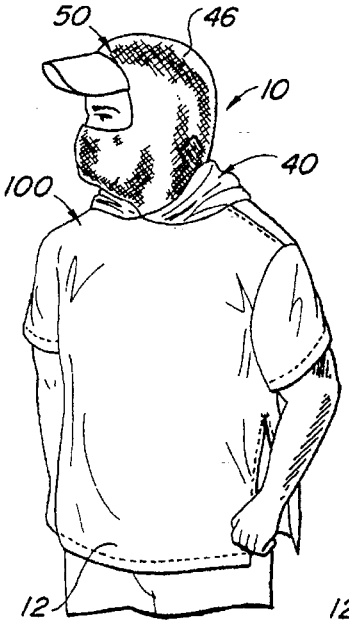
FIG. 4 is a front perspective view illustrating the head garment and bib being worn in accordance with a third preferred embodiment of the present invention.

FIG. 4 shows another embodiment of the present invention wherein the head garment 50 is a combined hood and face mask for use in cold weather environments. The hood may further be fitted with a bill or visor to shield the eyes. In this particular embodiment, the head garment 50 is worn by pulling the bib with the attached hood/face mask through the neck opening and, thereafter, pulling the hood and face mask over the head so that the bib is draped around the back of the neck. Because the embodiment is particularly designed for colder weather, the front panel 12 and rear panel 14 are most probably going to be worn in covering relation to the upper torso, as seen in FIG. 4.

Figure 5:
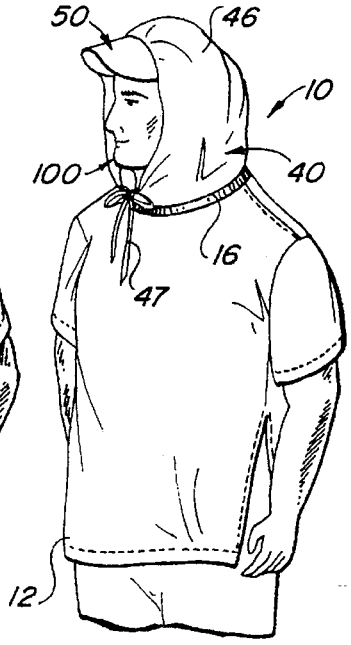
FIG. 5 is a front perspective view showing the bib and head garment being worn in accordance with yet another preferred embodiment of the present invention.

Referring to FIG. 5, the shirt 10 is shown worn in a conventional manner with the bib panel 40 and head garment 50 worn on the wearer's head. In this figure, the bib panel 40 is shown with the tie strings 47 tied under the chin to pull the bib panel 40 over the ears and neck for protection against sunlight, wind, or cold.

While the invention has been shown and described in what is considered to be practical and preferred embodiments thereof, it is recognized that departures may be made within the spirit and scope of the following claims which, therefore, should not be limited except within the doctrine of equivalents.

Now that the invention has been described,

What is claimed is:

1. A shirt to be worn on the upper body of a wearer comprising:

a main front panel and a main rear panel each including a lower edge, said front and rear panels being attached to one another along corresponding peripheral edge portions to define a neck opening, opposite arm openings, and a bottom opening surrounded by said lower edges of said front and rear panels, a third panel attached to the shirt and defining a bib, said bib normally extending downwardly between said front and rear panels and including an upper edge, side opposite edges and a free end zone including a lower edge, a head garment integrally attached on the lower free end zone of said bib, and wherein said bib is structured to be pulled over the back of the wearer's head so that said head garment can be selectively worn on the wearer's head.

2. The shirt as set forth in claim 1 wherein said head garment includes a semi-stiff brim sized and configured to shade the eyes and face when worn on the wearer's head.

3. The shirt as set forth in claim 1 wherein said head garment includes a hood structured and configured to be worn over the wearer's head.

4. The shirt as set forth in claim 3 wherein said hood includes a face mask structured and configured to cover the nose, mouth, and lower face of the wearer.

5. The garment as set forth in claim 1 wherein said bib includes tie strings extending from said opposite side edges between said lower free end zone and said upper edge.

6. The garment as set forth in claim 1 wherein said front and rear panels are shaped and configured to cover the upper torso of the wearer.

7. A method of wearing the shirt of claim 5 comprising the steps of:

first pulling the shirt over the upper torso of the wearer so that the wearer's head passes through the bottom opening and between the front and rear panels and next, through the neck opening and further so that the wearer's arms pass through the bottom opening and through corresponding ones of the respective opposite arm openings with the front panel and rear panel substantially covering the upper torso and the bib and head garment disposed in concealed relation between the shirt and the wearer's upper torso, selectively pulling the bib and head garment over the wearer's head so that the bib and head garment are positioned behind the wearer's head, and fitting the head garment on the wearer's head so that the bib panel is draped down over the back of the wearer's head.

8. The method as set forth in claim 7 further including the step of:

pulling the front panel over the wearer's head so that the front panel and lower edge thereof are draped across the back of the neck and shoulders of the wearer.

9. The method as set forth in claim 7 further including the step of:

tying the tie strings behind the wearer's head to pull the bib together causing the wearer's face and a portion of the wearer's neck to be exposed.

10. The method as set forth in claim 7 further including the step of:

tying the tie strings below the chin to pull the bib across the sides of the wearer's head in covering relation to the wearer's ears and neck.

* * * * *